US005384631A

United States Patent [19]

Matsunami

[11] Patent Number: 5,384,631

[45] Date of Patent: Jan. 24, 1995

[54] AUTOMATIC DOCUMENT FEEDING APPARATUS

[75] Inventor: Tokumi Matsunami, Yokohama, Japan

[73] Assignee: Kabushiki Kaisha Toshiba, Kawasaki, Japan

[21] Appl. No.: 156,816

[22] Filed: Nov. 24, 1993

[30] Foreign Application Priority Data

Nov. 26, 1992 [JP] Japan ..... 4-316922
Nov. 17, 1993 [JP] Japan ..... 5-288258

[51] Int. Cl.[6] ..... G03G 21/00; B65H 7/08; B65H 7/14

[52] U.S. Cl. ..... 355/308; 271/110; 271/121; 271/262; 355/311

[58] Field of Search ..... 271/121, 122, 262, 258, 271/110; 355/308, 309, 311

[56] References Cited

U.S. PATENT DOCUMENTS 4,954,848 9/1990 Arima ..... 355/319
5,011,127 4/1991 Hamilton et al. ..... 271/262
5,029,837 7/1991 Uchiyama ..... 271/122 X
5,039,080 8/1991 Kato et al. ..... 271/122
5,050,854 9/1991 Tajima ..... 271/122
5,076,563 12/1991 Namba et al. ..... 271/122 X
5,172,899 12/1992 Tajima ..... 271/122

*Primary Examiner*—Fred L. Braun
*Attorney, Agent, or Firm*—Foley & Lardner

[57] ABSTRACT

An automatic document feeding apparatus including pickup rollers for picking up documents, a document feed limiting device for limiting the number of documents to one when two or more documents are picked up by the pickup rollers, and a document thickness detecting sensor for detecting the number of documents passing through the document feed limiting device as a thickness of the documents. When the sensor detects that two or more documents has been fed, the document feed limiting device is rotated reversely to return the documents upstream in the document feeding direction. The returned documents are supplied again to the document feed limiting device by the pickup rollers. The document limiting device repeats its own operation until the number of documents is limited to one. If the sensor detects that the number of documents is one, the document is supplied through the document feed limiting device.

3 Claims, 16 Drawing Sheets

AUTOMATIC DOCUMENT FEEDING APPARATUS

BACKGROUND OF THE INVENTION

1. Field of the Invention

This invention relates to an automatic document feeding apparatus for use in a copying machine, a filing apparatus having an image reading apparatus (scanner), an image forming apparatus, having an image filing section capable of document filing and copying, and the like.

2. Description of the Related Art

Today, an automatic document feeder (ADF) is widely used in a copying machine, a filing apparatus, an image forming apparatus with a filing section, or the like, to copy or store a great number of documents (images) at high speed. The ADF saves a user from setting documents on a document reading plane of an image reading apparatus one by one and from changing documents to others. The ADF also saves a user from reversing a document on the document reading plane when both sides of the document are copied or stored. Furthermore, a user can perform any other operation during the copying or memorizing of documents, resulting in greater operational efficiency.

An ADF generally includes a document tray, a document pickup unit, a separation/feed unit, an aligning unit, a transporting unit, a discharge unit, and a discharge tray.

An ADF having the above constitution performs the following operations. Documents set in the document tray are picked up by the pickup unit and sent to the separation/feed unit. The documents are then separated one from another by the separation/feed unit. Each document is fed to the aligning unit in which any skew of the document to its transporting direction is removed. After that, the document is transported by the transporting unit to a predetermined position of a document reading plane of a reading apparatus or a copying machine. Image information, such as characters and graphs, is read out from the document by the reading apparatus or copying machine, and the document is discharged from the discharge unit onto the discharge tray. This operation is repeated until all the documents are fed from the document tray.

An example of such an ADF is disclosed in, for example, U.S. Pat. No. 4,954,848.

In ADFs, there is fear that two or more documents are picked up from the document tray when they are stacked one on another. To eliminate this problem, most of them incorporate a separation/feed unit for separating documents one from another. However, the documents cannot always be separated owing to their thicknesses and conditions such as cohesion (adsorption), folding, and curving, even though the separation/feed unit is prepared. To resolve this problem, ADFs include a stacked-document detector for detecting two or more documents which are supplied with them stacked one on another. when the detector detects stacked documents, it stops the ADF.

However, the ADF including the stacked-document detector has the drawbacks that, when the detector detects stacked documents, a user has to stop his operation and reset the documents himself or herself. If the user is away from the ADF, the ADF remains stopped.

SUMMARY OF THE INVENTION

An object of the present invention is to provide an automatic document feeding apparatus that operates with great efficiency.

Another object of the present invention is to provide an automatic document feeding apparatus capable of being operated without calling back away a user from the apparatus.

Still another object of the present invention is to provide an automatic document feeding apparatus capable of returning stacked documents and picking them up again one by one.

According to a first aspect of the present invention, there is provided an apparatus for feeding a document to an image reading section of an image forming apparatus, comprising: a document table for stacking a plurality of documents; feeding means for separating the documents one by one stacked on the document table and for feeding the documents one by one to the image reading section from the document table; means for detecting the condition of each of the documents fed by the feeding means; and means for controlling the feeding means to reversely feed the documents toward the document table by a predetermined distance when the detecting means detects that two or more documents are simultaneously fed by the feeding means.

According to a second aspect of the present invention, there is provided an apparatus for feeding a document to an image reading section of an image forming apparatus, comprising: a document table for stacking a plurality of documents; feeding means for separating one by one documents stacked on the document table and for feeding the documents one by one to the image reading section from the document table; means for detecting the condition of each of the documents fed by the feeding means; first control means for controlling the feeding means to reversely feed the documents toward the document table by a predetermined distance when the detecting means detects that two or more documents are simultaneously fed by the feeding means; and second control means for controlling the feeding means to separate the documents, fed toward the document table by the first control means, and feed the documents one by one, to the image reading section again.

According to a third aspect of the present invention, there is provided an apparatus for feeding a document to an image reading section of an image forming apparatus, comprising: a document table for stacking a plurality of documents; feeding means for separating the documents one by one stacked on the document table and for feeding the documents one by one to the image reading section from the document table; means for detecting the condition of each of the documents fed by the feeding means; first control means for controlling the feeding means to feed the documents reversely toward the document table by a predetermined distance when the detecting means detects that two or more documents are simultaneously fed by the feeding means; second control means for controlling the feeding means to separated the documents, fed toward the document table by the first control means, and feed the documents again one by one, to the image reading section; means for counting the number of operations of the second control means; and third control means for stopping the operation of the first control means and the second control means when the counting means counts a predetermined number.

In the automatic document feeding apparatus, when it is detected that two or more documents are supplied, they are returned toward the document table. The returned documents are fed again to the feeding section to separate them one from another. The documents can thus be re-separated automatically, thereby decreasing the number of times by which the apparatus stops and improving its operational efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 7A through 7C are views of operations of the separation/feed unit shown in FIGS. 4A and 4B, in which FIG. 7A is a schematic view showing no documents, FIG. 7B is a schematic view showing one document, and FIG. 7C is a schematic view showing two (or more) documents;

FIGS. 11A through 11D are schematic views showing documents transferred between the stacked-document sensor of FIG. 8, in which FIG. 11A is a schematic view of a flat document, FIG. 11B is a schematic view of a curved document, FIG. 11C is a schematic view of two (or more) documents stacked one on another, and FIG. 11D is a schematic view of two (or more) documents stacked one on another and including at least one curved document;

FIGS. 12A through 12C are schematic views of detection outputs of the stacked-document sensors with respect to the document shown in FIG. 11A, in which FIG. 12A is a schematic view of the detection output of one of the sensors, FIG. 12B is a schematic view of the detection output of the other sensor, and FIG. 12C is a schematic view of the detection outputs of both sensors;

FIGS. 13A through 13C are schematic views of detection outputs of the stacked-document sensors with respect to the document shown in FIG. 11B, in which FIG. 13A is a schematic view of the detection output of one sensor, FIG. 13B is a schematic view of the detection output of the other sensor, and FIG. 13C is a schematic view of the detection outputs of both the sensors;

FIGS. 14A through 14C are schematic views of detection outputs of the stacked-document sensors with respect to the documents shown in FIG. 11C, in which FIG. 14A is a schematic view of detection output of one of the sensor, FIG. 14B is a schematic view of detection output of the other sensor, and FIG. 14C is a schematic view of the detection outputs of both the sensors;

FIGS. 15A through 15C are schematic views of detection outputs of the stacked-document sensors with respect to the documents shown in FIG. 11D, in which FIG. 15A is a schematic view of the detection output of one of the sensors, FIG. 15B is a schematic view of detection output of the other sensor, and FIG. 15C is a schematic view of the detection outputs of both the sensors;

DETAILED DESCRIPTION OF THE PREFERRED EMBODIMENTS

An automatic document feeding apparatus according to one embodiment of the present invention will now be described, with reference to the accompanying drawings.

Figure 1:
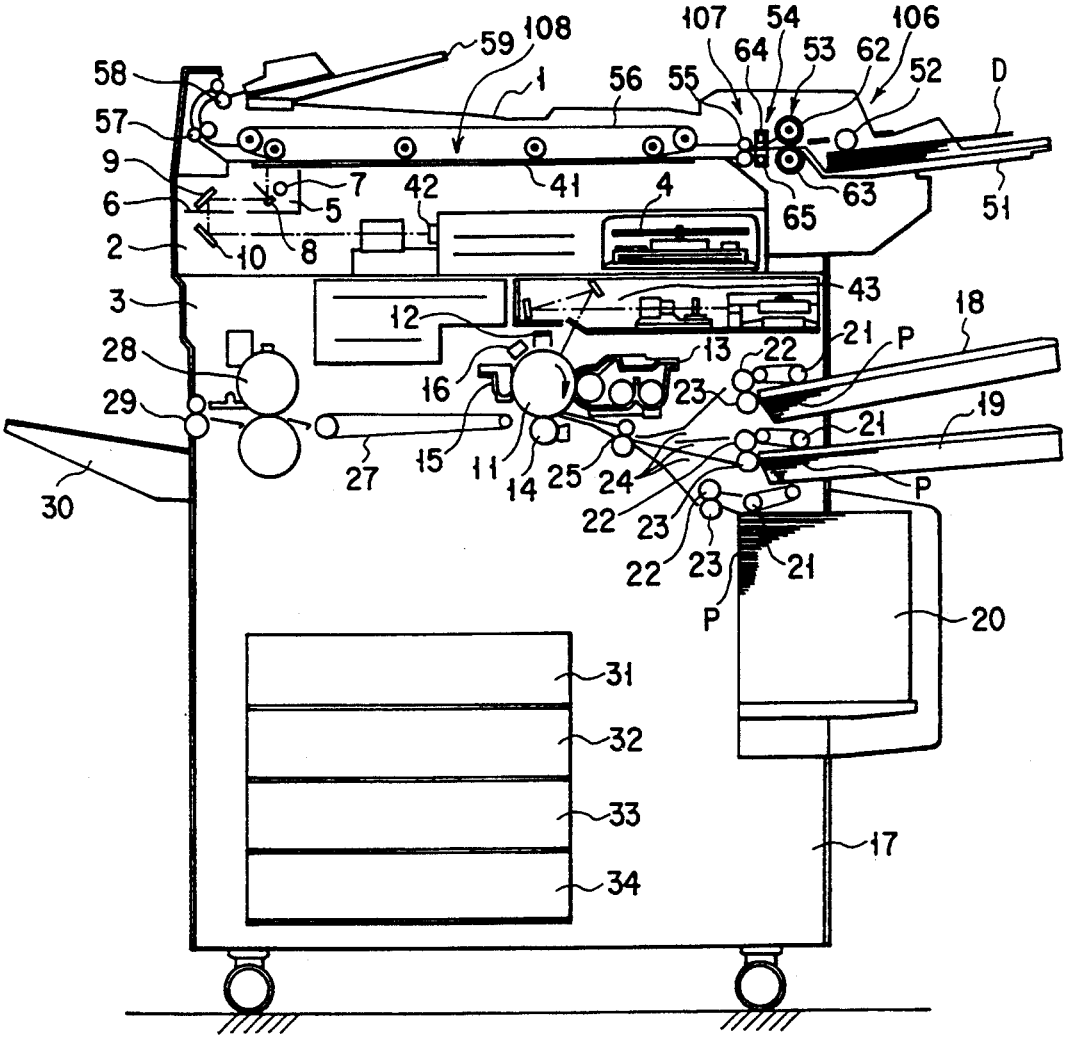
FIG. 1 is a schematic view of an image forming apparatus, having an automatic document feeding apparatus, according to the present invention.

FIG. 1 shows an image forming apparatus, having an image filing section, incorporating the automatic document feeding apparatus of the present invention.

As shown in FIG. 1, the image forming apparatus includes an ADF (Automatic Document Feeder) 1, a scanner (image reading unit) 2, a laser beam printer apparatus (image forming apparatus) 3, an optical disk memory device (image data storing device) 4, a controller (data inputting/outputting unit), which is described later, and the like.

Figure 2:
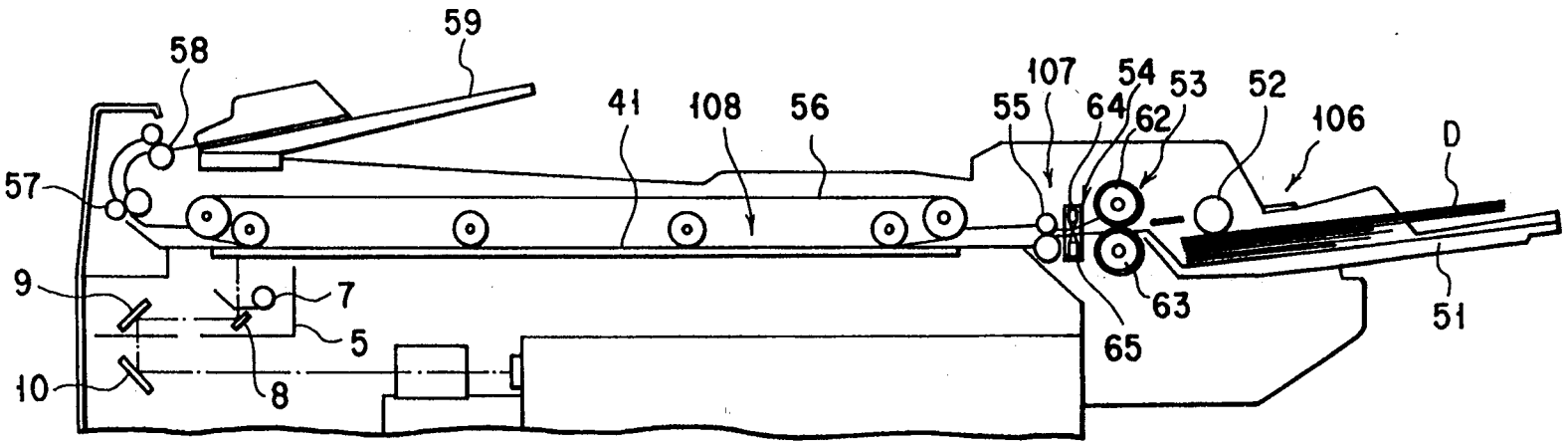
FIG. 2 is a schematic view showing the automatic document feeding apparatus incorporated in the image forming apparatus shown in FIG. 1.

The ADF 1 includes a document pickup unit 106 (detailed in FIG. 3), a document separation/feed unit 107 (detailed in FIG. 2), and a document transporting unit 108 (detailed in FIG. 2).

The scanner 2 includes a first carriage 5 having a lamp 7 for illuminating a document to be scanned and a first mirror 8 for receiving light reflected by the document, a second carriage 6 having a second mirror 9 and a third mirror 10 both for guiding the light from the first mirror 8, a CCD sensor (photoelectric converting apparatus) 42, and a signal processing circuit, not shown.

The printer 3 includes a rotatable photoconductive drum member 11 on which an image to be output is formed, and a charging unit 12, a developing unit 13, a transferring roller 14, a cleaning unit 15, and a discharging lamp unit 16, which are arranged around the drum member 11 in the rotating direction thereof.

Paper cassettes 18 and 19 and an LCC (Large Capacity paper Cassette) 20 for containing sheet materials (paper) of different sizes are detachably mounted on one side of a main body 17 of the printer 3. Further, pickup rollers 21 for picking up paper p from the cassettes 18 and 19 and LCC 20 are arranged so that it can be put into contact with the paper P contained therein when the cassettes 18 and 19 and LCC 20 are inserted into the main body 17.

The pickup rollers 21 are each provided with a pair of feed roller 23 and separation roller 22 put on the roller 23, for separating sheet materials (paper) P one from another and feeding them to the transferring roller 14 one by one.

A paper guide 24 for guiding each of the sheet materials P picked up from any one of the paper cassettes 18 and 19 and LCC 20 is formed between the transferring roller 14 and the pair of separation roller 22 and feed roller 23.

A pair of aligning rollers 25, transferring roller 14, a transporting belt 27, a fixing unit 28, and a discharge roller 29 are arranged in this order on the paper guide 24 in the paper transporting direction.

A paper tray 30 for containing copied paper on which an image is formed by the image forming process, is attached to the other side of the main body 17.

The main body 17 includes a plurality of paper cassettes 31 to 34 as well as the paper cassettes 18 and 19 and LCC 20.

As shown in FIG. 2, the ADF 1 is formed above the document feed table 41 of the scanner 2 (FIG. 1), with a narrow space between them. The ADF 1 includes a document tray 51 (at one end) for holding documents D and setting them to be picked up in sequence. A pickup roller 52, which is lifted and lowered by a pickup roller lifting/lowering unit 101 (FIG.3) in the pickup unit 106, is disposed above the document tray 51.

On that supply side of the document tray 51 which is close to the table 41, a pair of separation/feed rollers 53 of the document separation/feed unit 107, and a pair of aligning rollers 55 are arranged in order in the feeding direction of the documents D. A stacked-document detecting sensor 54 is arranged between the aligning rollers 55 and the separation/feed rollers 53.

The separation/feed rollers 53 also serve to return the documents D to the pickup roller 52 when the sensor 54 detects that they are stacked one on another.

The documents D passing between the aligning rollers 55 are transported to a reading position on the document feed table 41 by means of a transporting belt 56 of the document transporting unit 108. Discharge rollers 57 and 58 for discharging the documents and a discharge tray 59 for receiving the discharged documents are disposed on the discharge side of the transporting belt 56.

Figure 3:
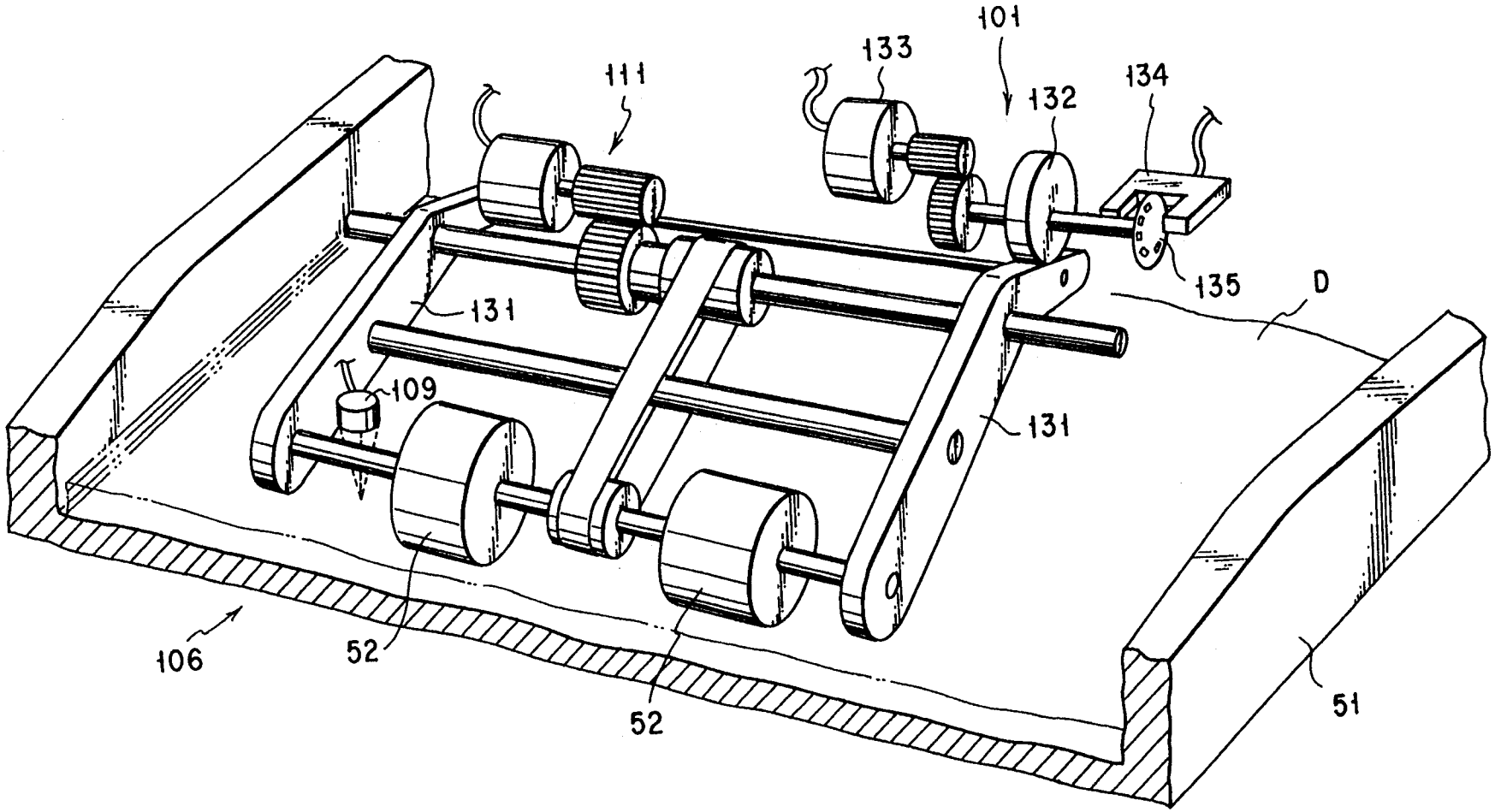
FIG. 3 is a schematic view showing a pickup roller unit incorporated in the automatic document feeder shown in FIG. 2.

In FIG. 3, the pickup roller 52 is held by arms 131 of the pickup roller lifting/lowering unit 101. One end of the arms 131 is pushed by an eccentric cam 132 arranged on one of the arms 131. The pickup roller 52 is lifted/lowered by a motor 133 for rotating the eccentric cam 132. A light-transmitting sensor 134 for detecting the rotating position of the eccentric cam 132, and a light-shield plate 135 having slits, are carried on a shaft of the cam 132. The pickup roller 52 is lifted by rotating the eccentric cam 132 by rotation of the motor 133 and pushing the eccentric cam 132 on the arm, and stopped by detecting the rotating position of the eccentric cam 132 using the light-shield plate 135 and the sensor 134, for controlling the motor 133.

An operation of the separation/feed unit 53 will be described more specifically.

Figure 4A:
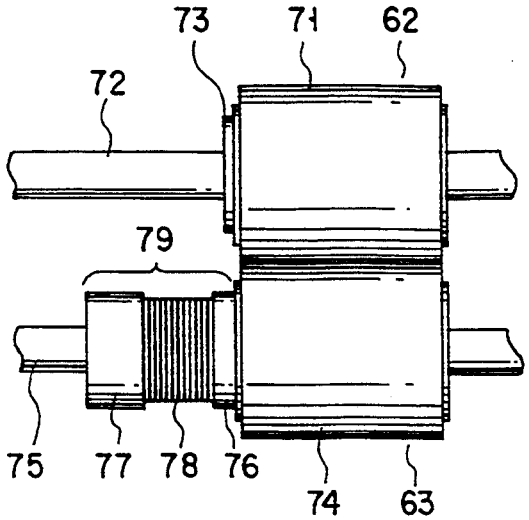
FIGS. 4A and 4B are respectively a front view and a side view of a separation/feed unit of the automatic document feeding apparatus shown in FIG. 2.
Figure 4B:
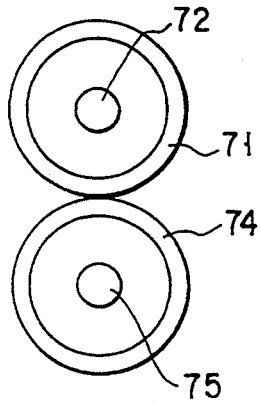

As shown in FIGS. 4A and 4B, the feed and separation rollers 62 and 63 of the separation/feed rollers 53 are tangent to each other in such a manner that their axes are parallel with each other.

The document feed roller 62 includes a document feed rubber roller 71 which lowers from above documents D and contacts them so as to feed the documents one by one, a document feed roller shaft 72, and a boss 73 for rotatably attaching the roller 71 to the shaft 72. The document feed roller shaft 72 is rotated forwardly and backwardly by a document feed roller driving unit 111. Normally, the document feed roller 62 is rotated forwardly (in the document feed direction toward the table 41 from the tray 51) by the document feed roller driving unit 111 (see FIG. 7A).

The document separation roller 63 includes a separation rubber roller 74 which rises from below stacked documents and contacts them to separate the stacked documents one from another, a document separation roller shaft 75, a boss 76 for rotatably attaching the shaft 75 to the roller 74, an arbor 77, and a spring 78 for connecting the boss 76 and arbor 77, to constitute a spring clutch 79. The arbor 77 fixedly supports the spring 78 in order to transmit the driving force of the document separation roller driving unit to the document separation roller shaft 75 so that the shaft 75 can be rotated in the direction opposite to the rotating direction of the document feed roller 62. However, the document separation roller 63 rotates in a counter direction when a piece of the document D is fed by the document feed roller 62.

Figure 5:
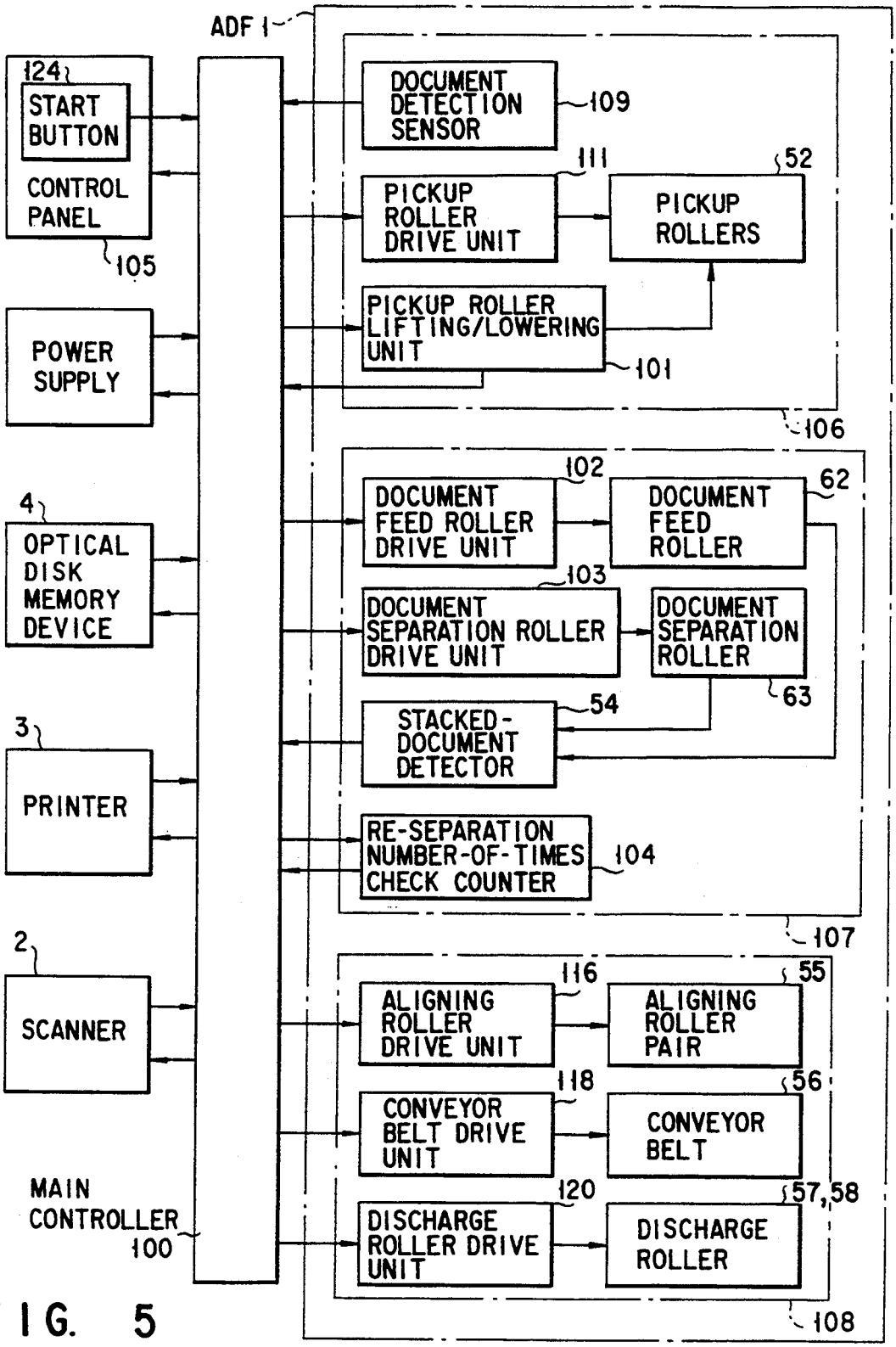
FIG. 5 is a block diagram showing the components of the image forming apparatus shown in FIG. 1.

FIG. 5 is a block diagram of the ADF 1. The ADF 1 is divided roughly into the pickup unit 106, the separation/feed unit 107, and the transporting unit 108.

A document detection sensor 109 for detecting whether documents are placed on the tray, pickup roller 52 for picking up the documents, the pickup roller drive unit 111 for driving the pickup roller, and the pickup roller lifting/lowering unit 101 for lifting/lowering the pickup roller, are connected with a controller 100 through the pickup unit 106.

A feed roller 62 and a separation roller 63, which are paired, for feeding or returning documents, a document feed roller drive unit 102 for driving the document feed roller 62, a document separation roller drive unit 103 for driving the document separation roller, a stacked-document detector 54 for detecting stacked documents transported by the rollers 62 and 63, and a re-separation number-of-time check counter 104 for counting the number of times of re-separation are connected with the controller 100 through the separation/feed unit 107.

The aligning roller pair 55 for aligning the documents, an aligning roller drive unit 116 for driving the aligning roller pair 55, a transporting belt 56 for transporting the document to a document reading position on the scanner 2, a transporting belt drive unit 118 for driving the transporting belt, document discharge rollers 57 and 58 for discharging the documents from the document reading position 41 to the paper tray 30, and a document discharge roller drive unit 120 for driving the discharge rollers 57 and 58 are connected with the controller 100 through the transporting unit 108.

The ADF 1, as well as the optical disk apparatus 4, printer 3 and scanner 2, are controlled by the main controller 100.

A detection position of the ADF at which the stacked documents D are detected, will now be described.

The separation/feed unit of the ADF 1 is capable of feeding documents D in the opposite direction. In order to feed the document in the opposite direction for the shortest time, it is desirable that some of the documents D be interposed between the separation and feed rollers 53. In view of this, it is desirable that the stacked-document detector 54, i.e., the detecting position be located such that the leading edge of a document passes the separation/feed rollers 53 but the trailing edge thereof does not.

Figure 6:
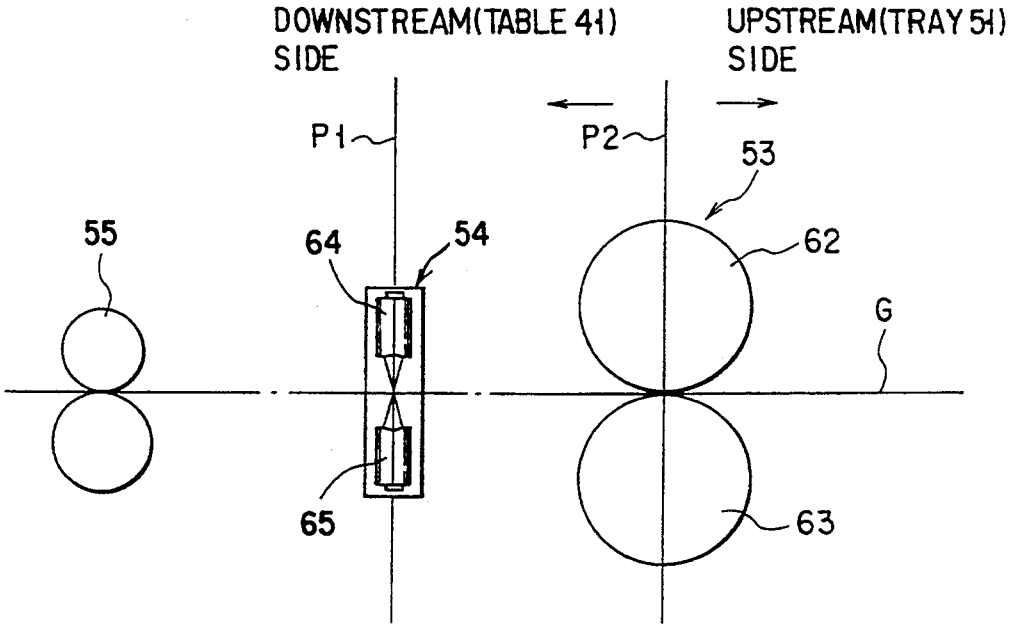
FIG. 6 is a schematic view showing a document separation position and a stacked-document detection position of the automatic document feeding apparatus shown in FIG. 2.

More specifically, as is apparent from FIG. 6, as a detecting point P1 comes closer to a separation/feed point (contact between the separation roller 63 and feed roller 62) P2, time for returning the stacked documents D to the upstream side (tray 51) of the point P2 can be shortened when the re-separation mode is set.

Consequently, in the ADF 1, the detecting point P1 is located on the downstream side (table 41) of the separation/feed point P2 as close as possible to the point P2, and a distance between the points P1 and P2 is, for example, 20 mm.

The re-separation mode will now be described, in detail, which reference to FIGS. 7A through 7C.

Figure 7A:
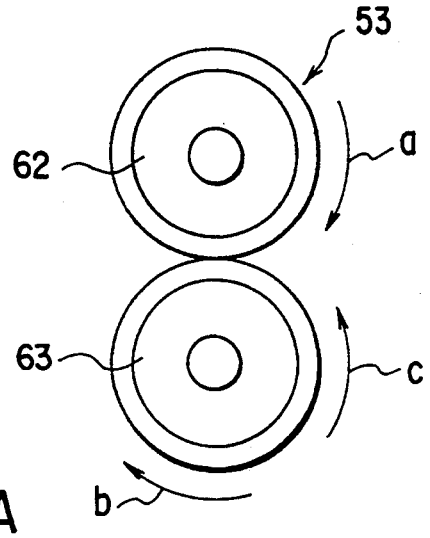
Figure 7B:
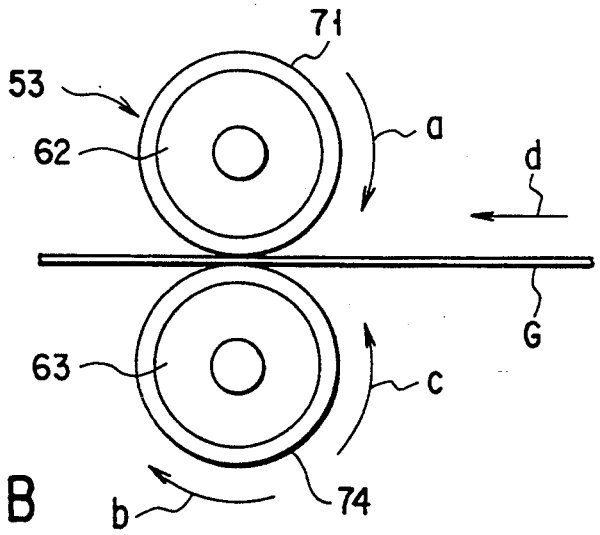
Figure 7C:
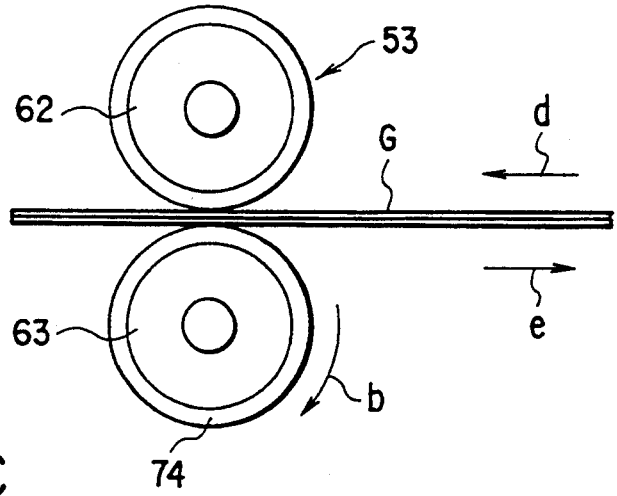

FIGS. 7A through 7C are views each showing a relationship between rotating directions of feed and separation rollers 62 and 63 and a feed direction of documents D which depends upon the number of the documents.

According to FIG. 7A, the feed and separation rollers 62 and 63 are located in contact with each other such that their axes are parallel with each other, and no documents are fed between them. The feed roller 62 is rotated in a forward direction indicated by arrow a. In contrast, the separation roller 63 receives a driving force from the separation roller shaft 75 so as to be rotated in a backward direction indicated by arrow b by the spring clutch 79, and also receives a driving force corresponding to the forward direction indicated by arrow c from the feed roller 62 since the separation roller 63 is tangent to the feed roller 62. A friction coefficient $\mu_1$ between the document feed rubber roller 71 and document separation rubber roller 74 is greater than a friction coefficient $\mu_2$ in the spring clutch 79, a slip occurs in the spring clutch 79, and the separation roller 63 is rotated in the direction (which is opposite to the rotating direction of the feed roller 62) indicated by arrow c.

When one document is interposed between the feed and separation rollers 62 and 63, as shown in FIG. 7B, a friction coefficient $\mu_3$ between the surface 71 of feed rubber roller and the document D, and a friction coefficient $\mu_4$ between the document D and the separation rubber roller 74 are each greater than the friction coefficient $\mu_2$. Therefore, when the transporting force due to the forward rotation of the feed roller 62 indicated by arrow a, that is, the driving force for transporting the documents downstream (to the table 41) in the direction indicated by arrow d is transmitted to the separation roller 63 through the documents, a slip occurs in the spring clutch 79, and the separation roller 63 is rotated in the direction indicated by arrow c.

There is the following relationship among friction coefficient $\mu_2$ in spring clutch 79, friction coefficient $\mu_4$ between document D and separation rubber roller 74, and friction coefficient $\mu_5$ between two or more documents D:

$$\mu_4 > \mu_2 > \mu_5$$

As is understood from the above relationship, when two documents D are interposed between the feed and separation rollers 62 and 63 as shown in FIG. 7C, a slip occurs between the two documents, which prevents the driving force indicated by arrow a from being transmitted to the document separation rubber roller 74 from the feed roller 62. Thus the separation roller 63 is rotated in the direction indicated by arrow b by the driving force of the document separation roller shaft 75. The lower one of the two documents contacting the separation roller 63 is then returned upstream (to the tray 51) in the direction indicated by arrow e, and the upper one of them contacting the feed roller 62 is supplied to the pair of aligning rollers 55 in the direction indicated by arrow d.

If three or more documents D are interposed between the feed and separation rollers 62 and 63, the lower documents contacting the separation roller 63 are returned in sequence, and only the uppermost document D is fed to the pair of aligning rollers 55.

Figure 8:
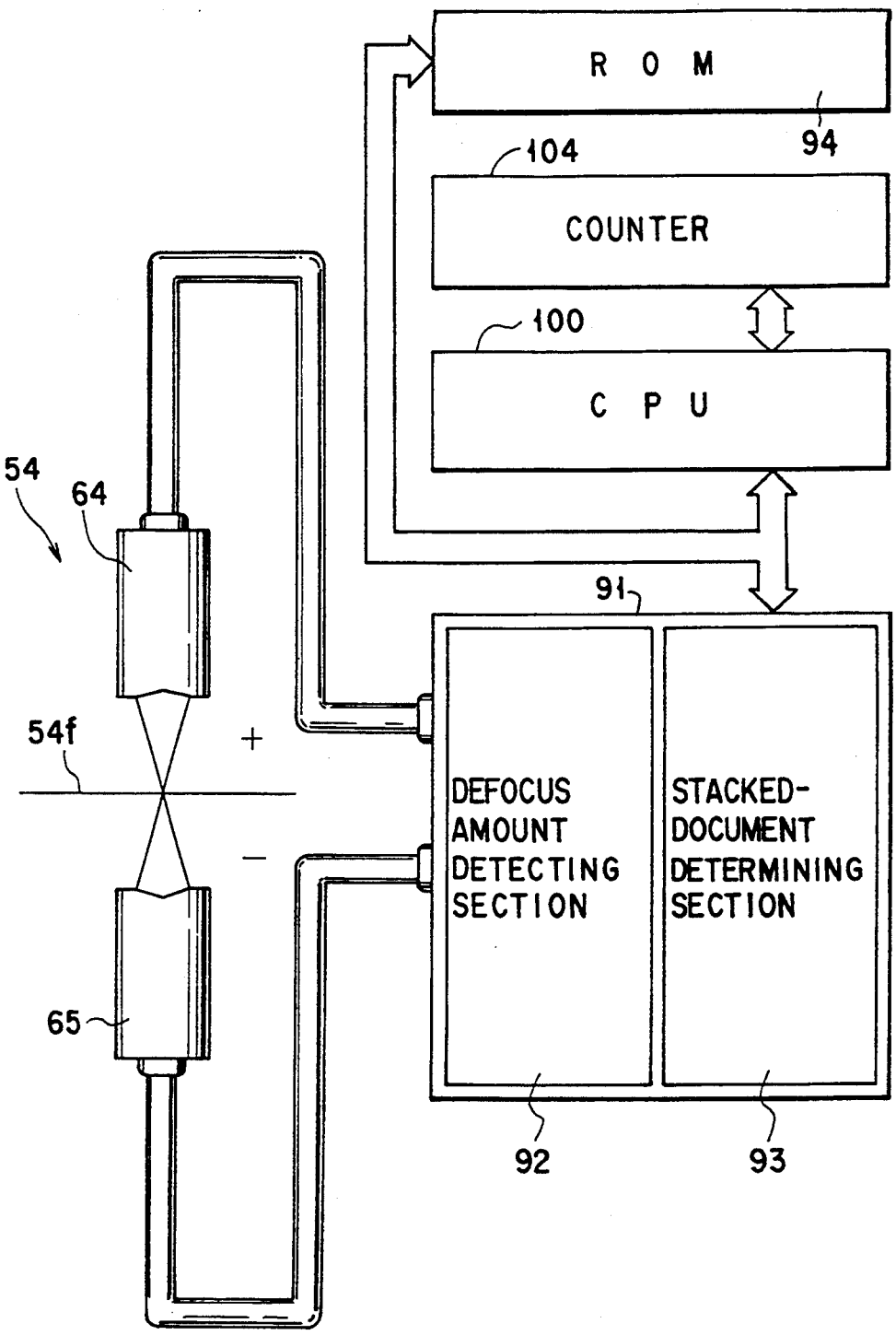
FIG. 8 is a schematic view of stacked-document sensors of the automatic document feeding apparatus shown in FIG. 2.

A constitution of the stacked-document detector 54 will now be described with reference to FIG. 8.

The sensors 64 and 65, which are optical defocus detecting sensors, are connected to a detection circuit 91. A signal output from the detection circuit 91 is supplied to the main controller 100. Using a semiconductor laser as a light source, the sensors 64 and 65 converts an optical signal representing a distance between a focal point **54*f* and a detection surface into an electrical signal, and output the electrical signal to the detection circuit 91. The distance detected by the sensors 64 and 65** falls within a range between −300 and +300 μm, and the resolution of the sensors is 1 μm.

The detection circuit 91 includes a defocus amount detecting section 92 and a stacked-document determining section 93. The signals output from the sensors 64 and 65 are converted into a signal representing the amount of defocus by the defocus amount detecting section 92, and the stacked-document determining section 93 determines whether stacked documents are supplied or not.

A method for detecting stacked documents using the sensors 64 and 65 will be described in detail.

The detection circuit 91 compares thickness T of document D with the maximum tolerance S and, when the thickness exceeds the maximum tolerance, detects stacked documents. The maximum tolerance S is determined in advance based on the range (e.g., 70 to 130 μm) of thickness of documents D usable in the ADF 1 and stored in a ROM 94. The maximum tolerance S is set to, for example, 135 μm. It is needless to say that a deviation of 5 μm from 130 μm of thickness T of document D which can be fed is a margin to prevent a feed error caused by malfunction due to a deviation from the thickness of document D, a difference between the sensors 64 and 65, an error in mounting the sensors, or a variation in temperature of the sensors.

If stacked documents D each having a thickness of 70 μm are fed, the thickness T of the documents D is at least 140 μm which is larger than the maximum tolerance S of 135 μm. In contrast, if one document D having a thickness of 130 μm is fed, the detection circuit detects that the document D is not stacked on the other documents since the thickness is smaller than the maximum tolerance S.

As described below, thickness T is obtained by the defocus amount detecting section 92 of the detection circuit 91 in response to signals output from the sensors 64 and 65.

Figure 9:
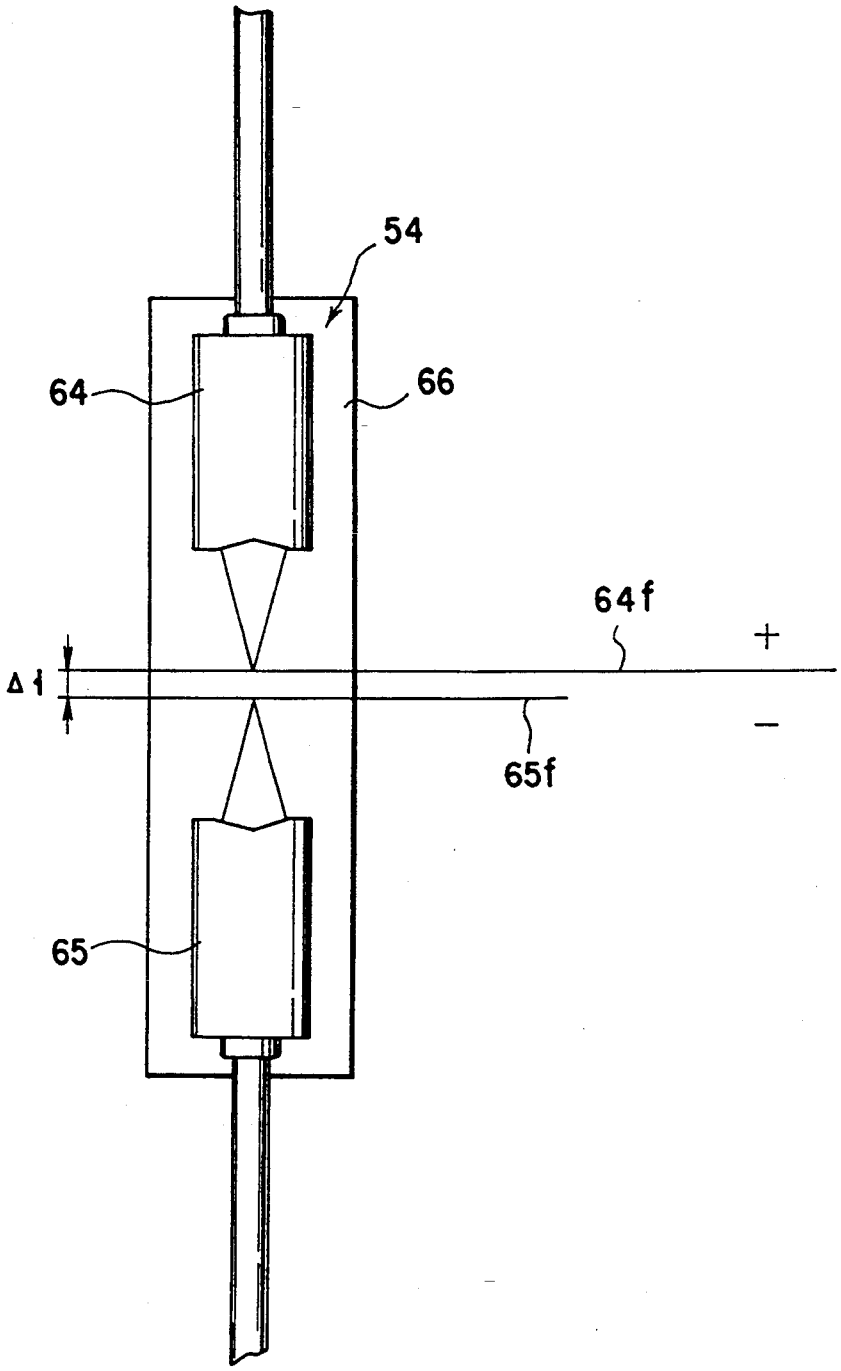
FIGS. 9, 10A and 10B are schematic views each showing a defocus state of the stacked-document sensors shown in FIG. 8.

Referring to FIG. 9, the sensors 64 and 65 are paired and arranged face to face such that their focal points coincide with each other. These sensors are fixed in one supporting member 66 to keep a virtually constant distance between them.

A focal point 64*f* of the upper sensor 64 is managed as a reference measuring point. Since the focal points 64*f* and 65*f* of the sensors 64 and 65 can easily be detected by their output signals, the focal point 65*f* of the sensor 65 is adjusted, using the output of the sensor 64 as a reference signal. Therefore, even if a difference Δ1 occurs between the focal points of the sensors 64 and 65, its amount can easily be detected.

Figure 10A:
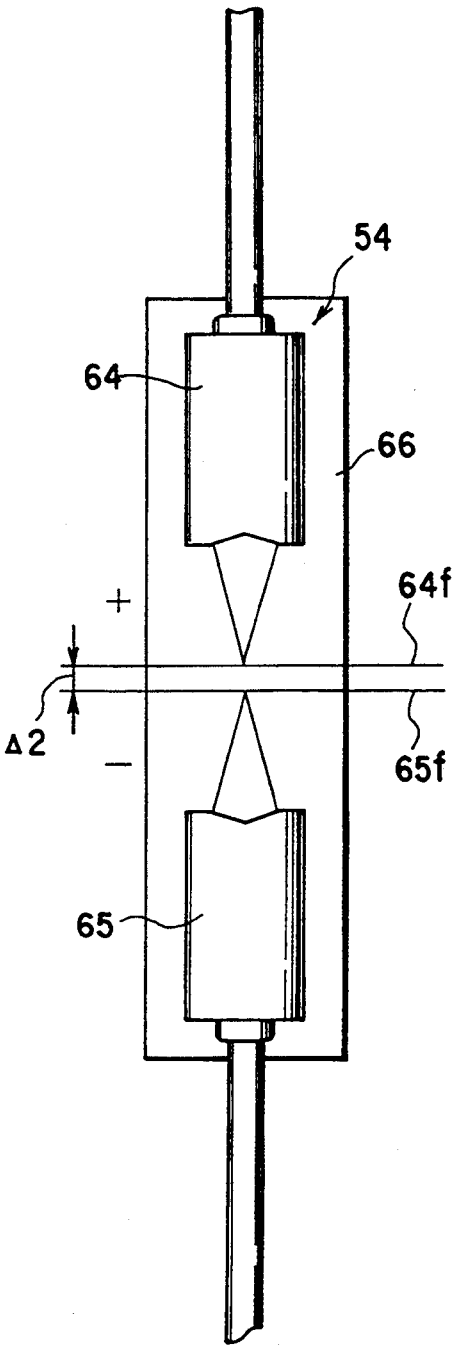
Figure 10B:
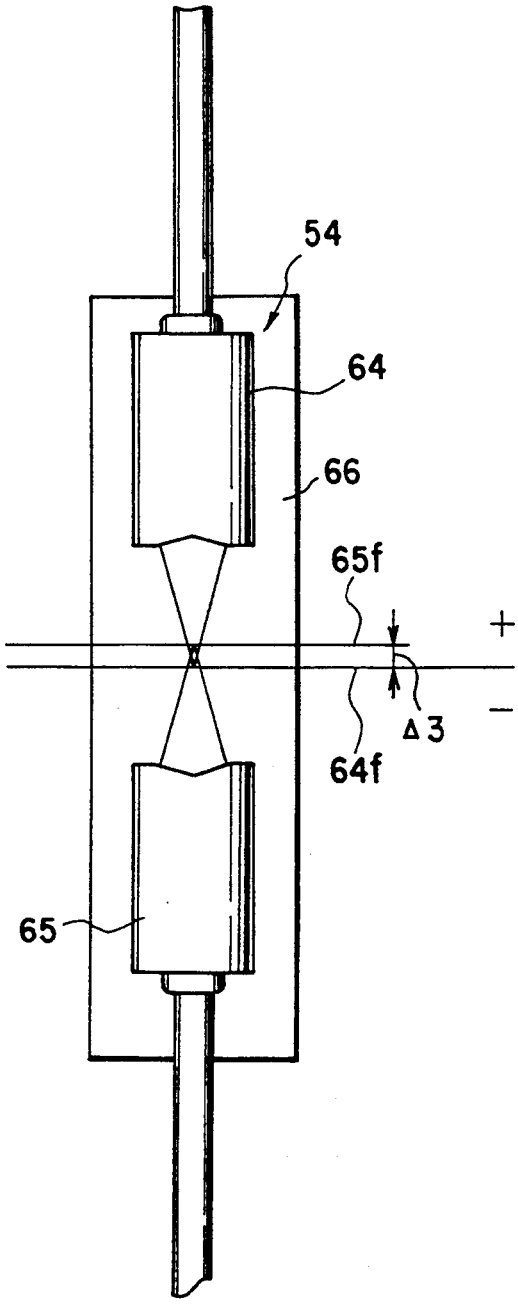

If the focal point 65*f* of the sensor 65 is located at that position on the minus (−) side which does not contact the focal point 64*f* of the sensor 64, as shown in FIG. 10A, a difference Δ2 has a positive value. On the contrary, if the focal point 65*f* is located at that position on the plus (+) side which overlaps the focal point 64*f*, as shown in FIG. 10B, a difference Δ3 has a negative value.

Figure 11A:
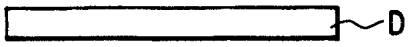

FIGS. 11A to 11D are views showing various states of documents, and FIGS. 12A to 12C, 13A to 13C, 14A to 14C, and 15A to 15C are views showing output signals of sensors 64 and 65 corresponding to the documents shown in FIGS. 11A to lid and signals representing thickness synthesized by the defocus amount detecting section 92. In FIGS. 12A through 15C, the ordinate indicates a variation in thickness of document D, and the abscissa indicates a variation in length of document D.

Figure 12A:
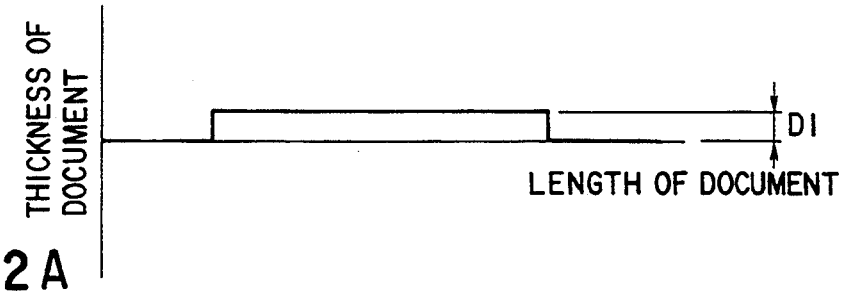
Figure 12B:
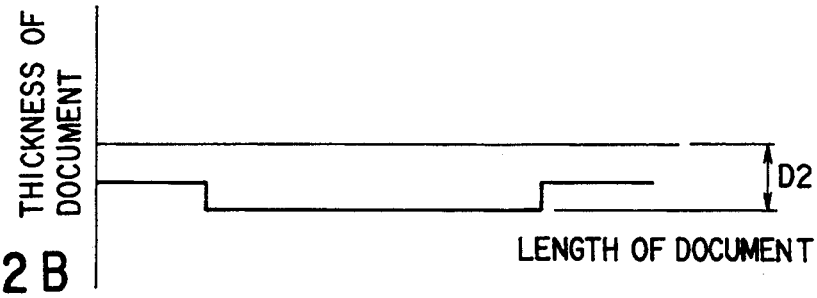

When only one flat document D passes between the sensors 64 and 65 as shown in FIG. 11A, these sensors output detection signals having waveforms shown in FIGS. 12A and 12B. The detection signals are synthesized by the defocus amount detecting section 92 into a signal having the synthesized waveform shown in FIG. 12C. The output signal shown in FIG. 12C contains a component corresponding to the focal point 65*f* of the sensor 65 offset in the minus direction (see FIG. 10A).

Figure 12C:
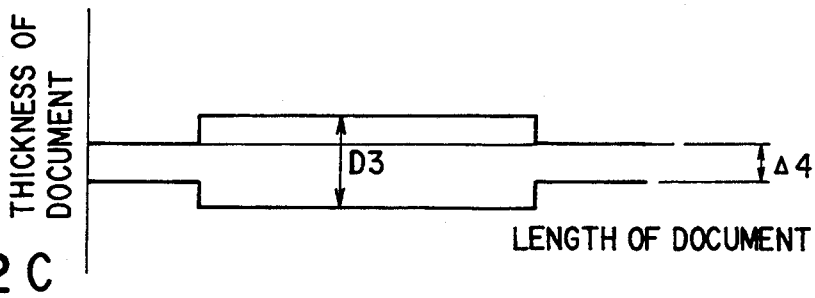

More specifically, in FIGS. 12A to 12C, thickness T1 of the flat document D is obtained by subtracting a difference Δ4 in focal point 64*f* and 65*f* between the sensors 64 and 65 from the sum D3 of distance D1 between the focal point 64*f* of sensor 64 and the detection position of document D and distance D2 between that of sensor 65 and the detection position.

Figure 11B:
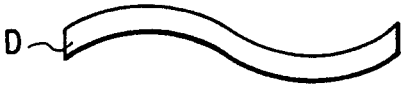
Figures 13A, 13B, 13C:
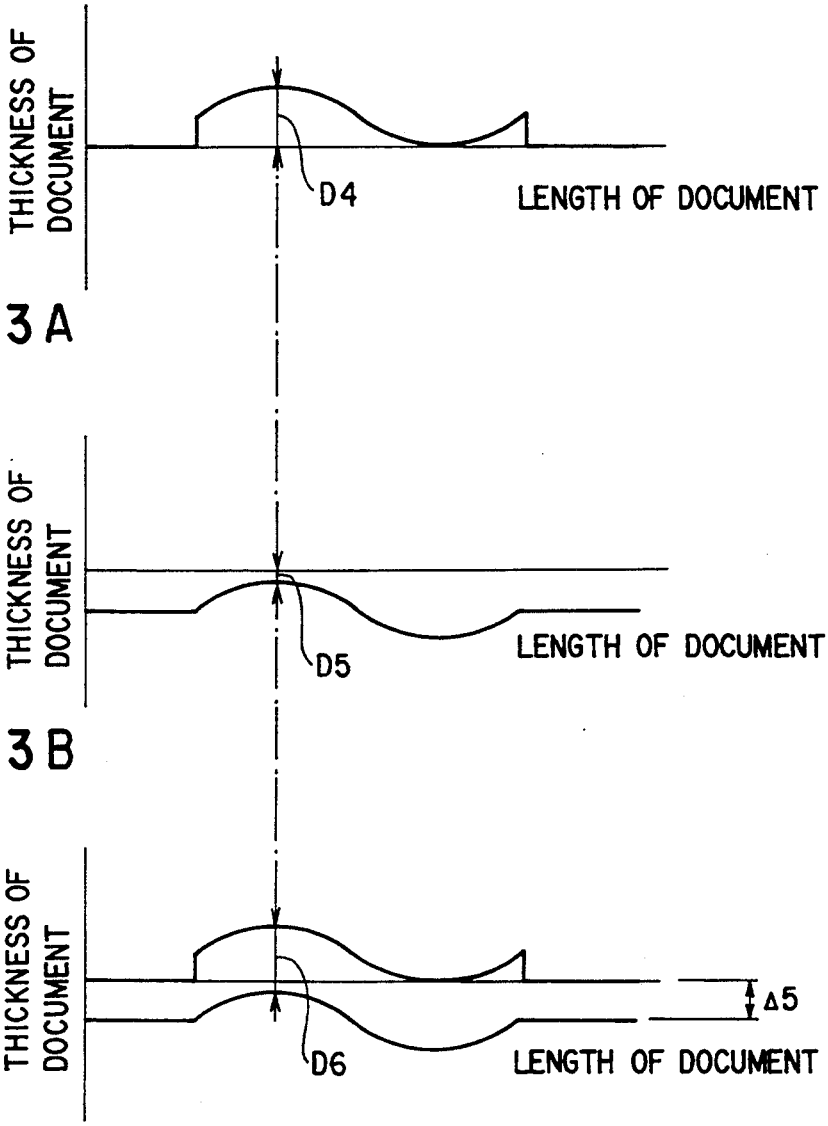

When a document D is curved as shown in FIG. 11B, the sensors 64 and 65 output detection signals and thickness signals as shown in FIGS. 13A to 13C. In this case, thickness T2 of the curved document D is obtained by subtracting a difference Δ5 in focal point 64*f* and 65*f* between the sensors 64 and 65 from the sum D6 of distance D4 between the focal point 64*f* of sensor 64 and the detection position of the curved document D and distance D5 between that of sensor 64 and the detection position, as in the case of the flat document shown in FIGS. 12A to 12C. The output signal shown in FIG. 13C contains a component corresponding to the focal point 65*f* of the sensor 65 offset in the minus direction (see FIG. 10A).

Figure 11C:
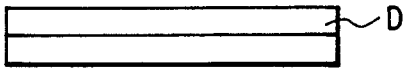
Figure 14A:
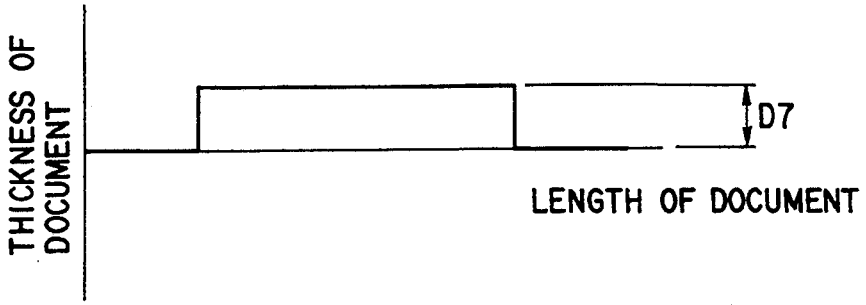
Figure 14B:
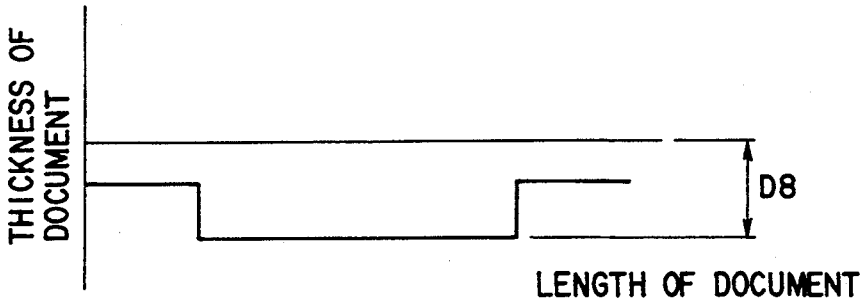
Figure 14C:
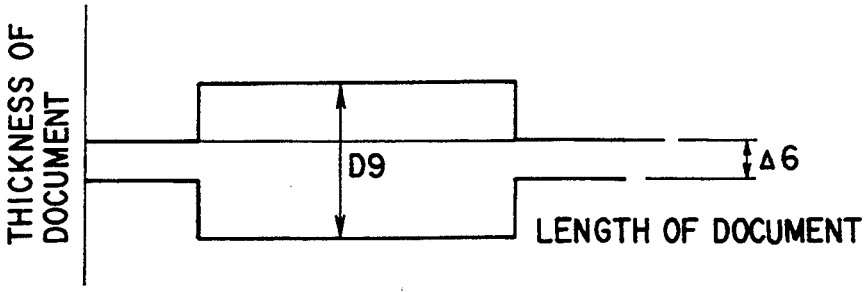

When two flat documents which are stacked on each other as shown in FIG. 11C, the sensors 64 and 65 output detection signals and thickness signals as shown in FIGS. 14A to 14C. According to FIGS. 14A to 14C, a value T3, which is obtained by subtracting a difference Δ6 in reference focal point from the sum D9 of distance D7 between the reference end point of the sensor 64 and the detecting position of the documents and distance D8 between that of the sensor 65 and the detecting position, corresponds to the thickness of the two documents. Needless to say, the output signal shown in FIG. 14C contains a component corresponding to the focal point of the sensor 65 offset in the minus direction.

Figure 11D:
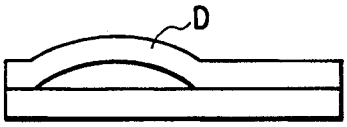
Figures 15A, 15B, 15C:
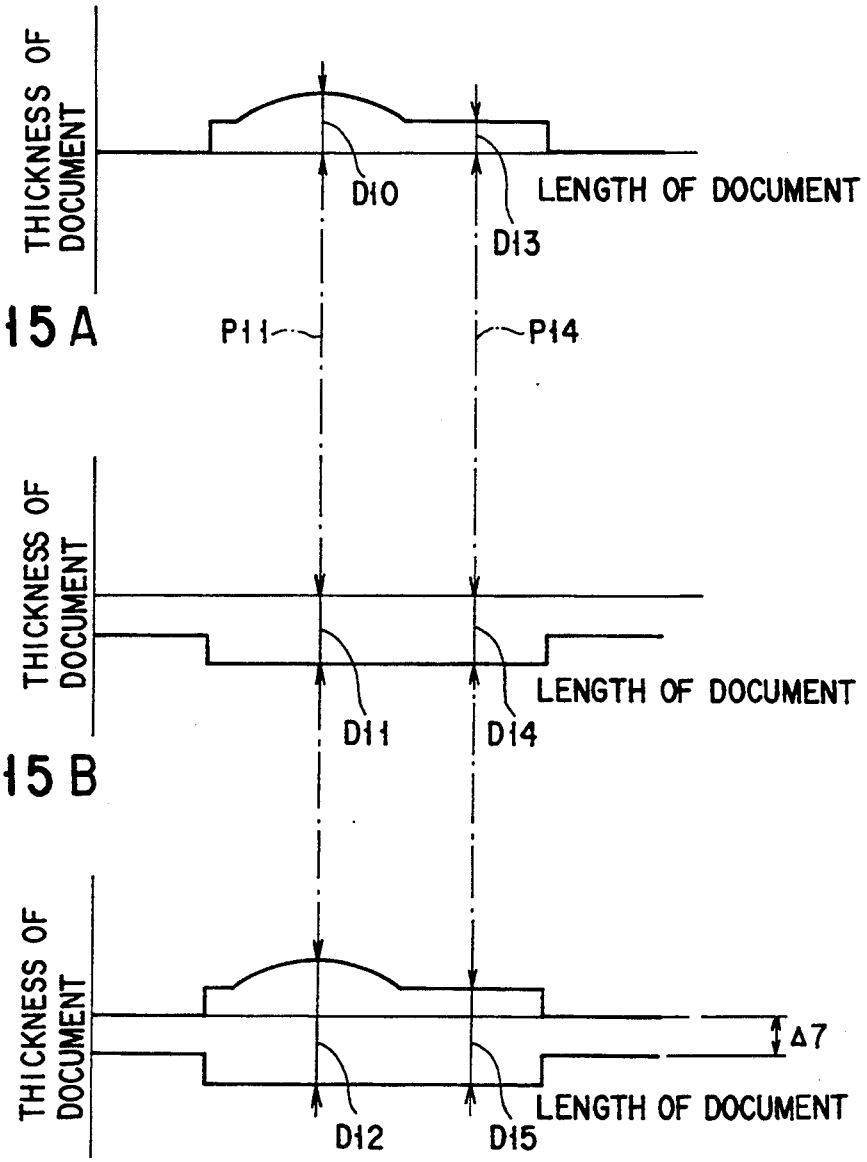

For example, when one of stacked documents is curved and the other is flat, as shown in FIG. 11D, the sensors 64 and 65 output detection signals and thickness signals as shown in FIGS. 15A to 15C. According to FIGS. 15A to 15C, the thickness T4 of the documents is calculated as follows. A value T41 is obtained by subtracting a difference Δ7 in focal point from the sum D12 of distance D10 at a detection point P11 between the focal point of the sensor 64 and the detection position of the documents and distance D11 at the detection point P11 between that of the sensor 65 and the detection position, and a value T42 is obtained by subtracting the difference Δ8 from the sum D15 of distance D13 at a detection point P14 between the focal point of the sensor 64 and the detection position of the documents and that of the sensor 65 and the detection position. The values T41 and T42 are compared with each other by the defocus amount detecting section 92 and main controller 100, and the larger one is regarded as the thickness T4 of the documents.

The values T1, T2, T3 and T4 so obtained are each compared with the maximum tolerance S by the stacked-document determining section 93. If the thickness of a document is, for example, 70 μm, T1 is 70 μm, T2 is also 70 μm, T3 is at least 140 μm for two documents, and T4 is 140 μm for two documents +α for a gap between them.

The stacked-document determining section 93 determines form the following formula that T3 and T4 each represent that stacked documents are fed.

140 μm −S (maximum tolerance of T)>0

If the thickness of document D is, for example, 130 μm, T1 and T2 are each 130 μm, T3 is at least 255 μm for two documents, and T4 is 255 μm for two documents +α for a gap between them.

It is determined from the following that T1 and T2 each represent that only one document is transported.

130 μm −S (maximum tolerance of T)<0

It is determined from the following that T3 and T4 each represent that stacked documents are transported.

140 μm −S (maximum tolerance of T)>0

Operations of the image forming apparatus and ADF 1 will now be described.

When a document D is read out, it is fed to a predetermined position of a document feed table 41 by means of the ADF 1. Then the lamp 7 emits light and, at the same time, the first and second carriages 5 and 6 are moved to scan the document D.

The light reflected by the document D is converted into an electrical signal corresponding to image information by the CCD sensor 42, and the image information is temporarily stored in an image memory (not shown). If the information has to be preserved, it is stored in the optical disk memory device 4.

The image information stored in the image memory is exposed on the photoconductive drum 11 along its axis by a laser exposure 43, in accordance with an image forming instruction or a print-out instruction.

Before the exposure of the image information, predetermined charges are applied to the surface of the photoconductive drum 11. An electrostatic latent image is formed by the exposure. The electrostatic latent image is developed by toners supplied from the developing unit 13 and, in other words, it is converted into a toner image.

The toner image is transferred by the transferring roller 14 to paper P supplied from the paper cassettes 18 and 19 or LCC 20.

The paper P to which the toner image is transferred, is transported to the fixing roller pair 28 by a transporting belt 27. The paper P is fixed and then discharged onto the paper tray 30 by the discharge roller 29.

Figure 16:
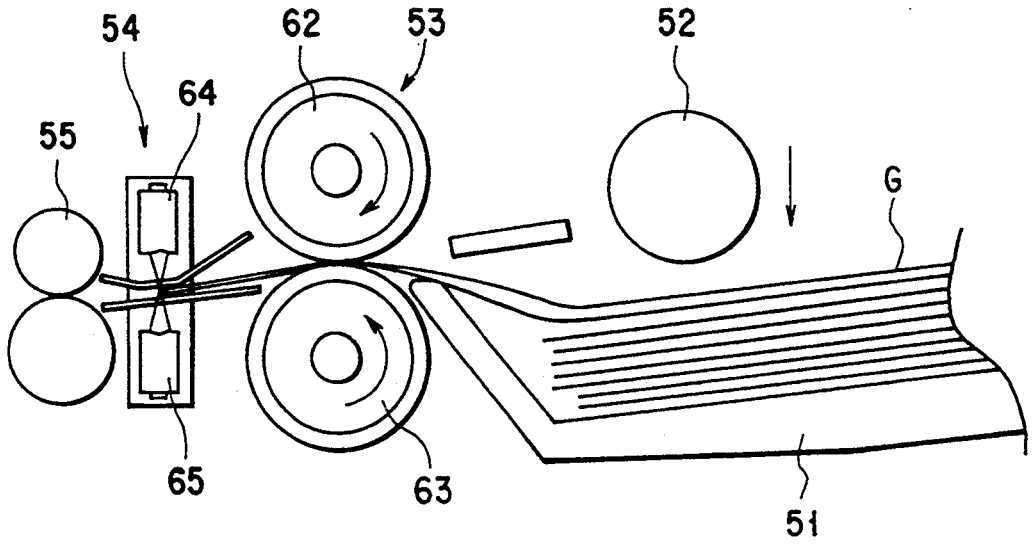
FIG. 16 is a schematic view showing two or more documents fed by the automatic document feeding apparatus shown in FIG. 2.
Figure 17:
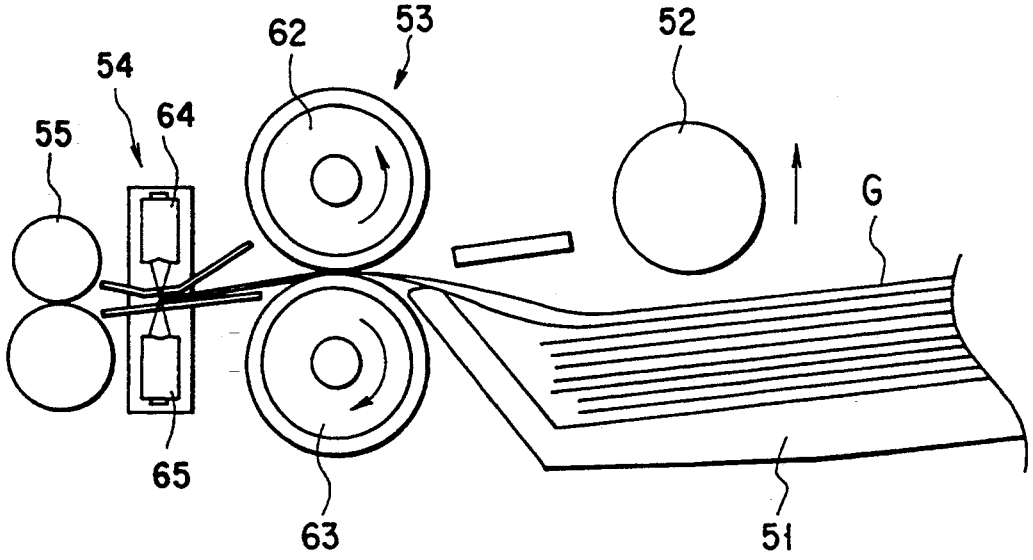
FIG. 17 is a schematic view showing the documents returned from the state of FIG. 16 and FIGS. 18A and 18B are flowcharts showing a document pickup operation and a document re-separation operation by the automatic document feeding apparatus shown in FIG. 2.
Figure 18A:
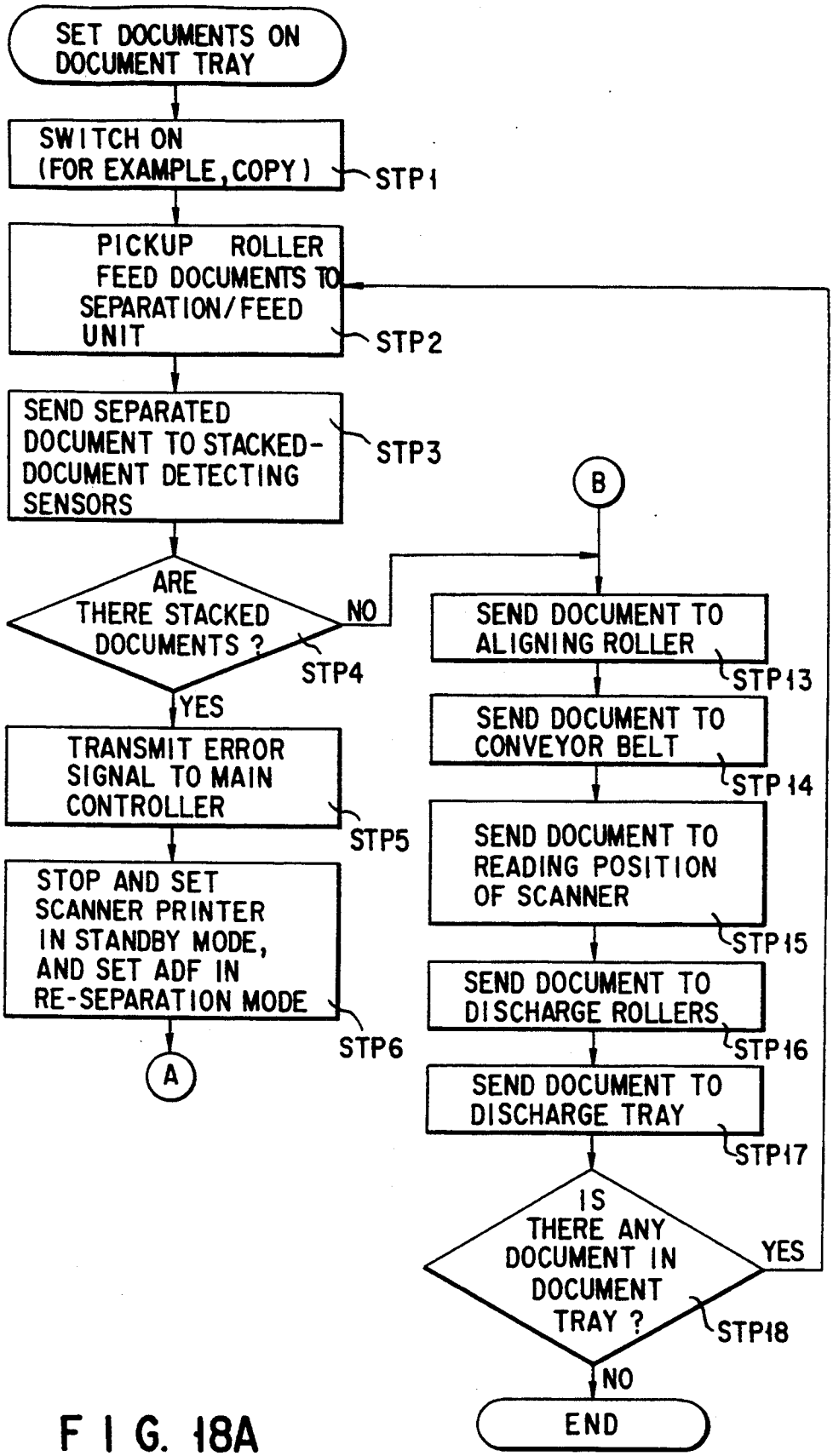
Figure 18B:
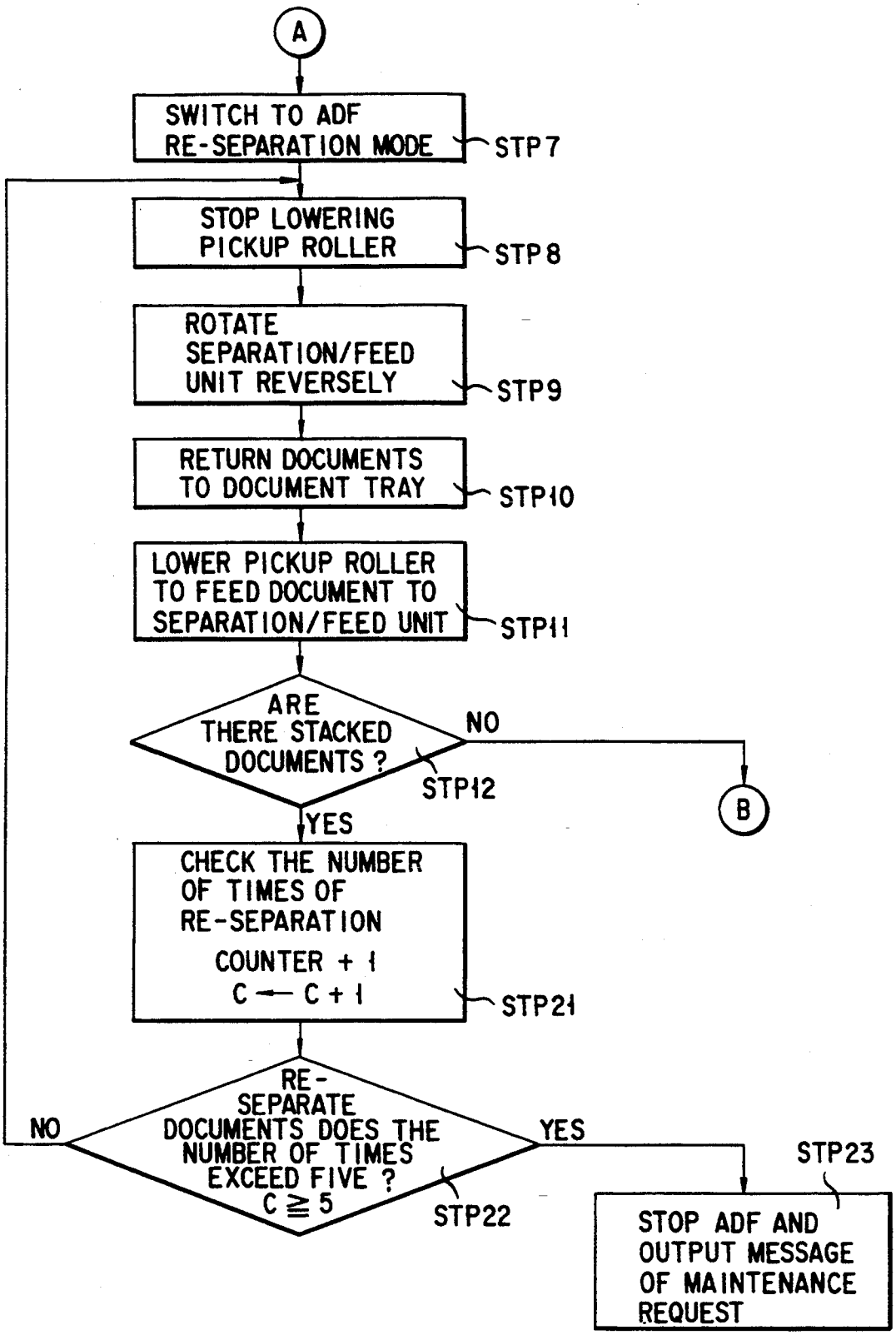

The operation of the ADF 1 will be also described in detail, with reference to FIGS. 1 through 6 and 16 and 17 and the flowcharts shown in FIGS. 18A and 18B.

Documents D are set on the document tray 51 such that their recording surfaces face down. A start button 124 of the image forming apparatus is depressed (STP 1), to give an instruction to lower the pickup roller 52 from the main controller 100 to the pickup roller lifting/lowering unit 101 and the pickup roller 52 is thus lowered onto the documents D placed on the document tray 51 by the pickup roller drive unit 111 (STP 2). After that, an instruction to feed the documents is given to the pickup roller drive unit 111 to rotate the pickup roller 52, with the result that the uppermost of the documents D is fed to the separation/feed rollers 53 (STP 3). If two or more documents are supplied, the upper one of them is separated from the others by the separation/-feed rollers 53 and sent to a position between the sensors 64 and 65. The sensors 64 and 65 sense an amount of defocus to detect whether the document D is put on the other document or documents (STP 4).

If the stacked documents are detected in response to signals from the sensors 64 and 65 (STP 4 - YES), the main controller 100 transmit a stacked-document error signal to each unit (STP 5), thereby setting the ADF 1 in the re-separation mode (STP 6). The scanner 2 interrupts a reading operation of the stacked document D, and is set in a standby mode. The printer 3 interrupts an image forming operation of the stacked document D, and is set in a standby mode. Further, the optical disk memory device 4 is set in a standby mode while it is ready for recording.

The ADF 1 separates one from the other documents based on the processing determined in the re-separation mode and then sends it to the aligning rollers 55 (STP 7 to 12, in FIG. 18B). The scanner 2, printer 3, and optical disk memory device 4 are restarted in accordance with the document D re-separated by the ADF 1.

If the sensors detect that the document D is not stacked (STP 4, No), it is supplied to the aligning rollers 55 (STP 13) and is supplied to the transporting belt 56 (STP 14). Then the document D is transported to the reading position of the table 41 on the scanner 2 by the transporting belt 56 (STP 15). Image information of the document D is optically read out by the well-known image reading process, and stored in the optical disk memory device 4 when the need arises.

The document D whose image information has been read out by the scanner 2, is transported to the discharge rollers 57 and 58 by the transporting belt 56 (STP 16) and discharged to the discharge tray 59 (STP 17). The above operation of the ADF 1 is repeated until all the documents D are picked up from the document tray (STP 18). The re-separation mode will now be described in detail, with reference to FIGS. 16 and 17 and the flowchart shown in FIG. 18B.

FIG. 16 shows stacked documents D which have reached a stacked-document detector 54 through the separation/feed rollers 53.

While a document feed roller 62 of the separation/-feed rollers 53 is rotated as indicated by the arrow, a separation roller thereof is rotated as indicated by the arrow, with the documents D interposed between the rollers 62 and 63.

In FIG. 16, the pickup rollers 52 have not contacted with the next document. In FIG. 17, the pickup rollers 52 interrupt and stop their own lowering operation or rises to a standby position so as not to prevent the documents D from being returned.

The ADF 1 is set in the re-separation mode in a states of the STP 4 in FIG. 18A (STP 7) and, before the stacked documents D reach the aligning rollers 55, the separation/feed rollers 53 receives an instruction from the main controller 100 to reversely rotate the feed and separation rollers 62 and 63 and to return the documents D to the document tray 51 (STP 8). More specifically, as shown in FIG. 7C, the feed roller 62 is rotated reversely upon receiving the driving force in a direction opposite to the normal direction from the feed roller drive unit 102 which has received an instruction from the main controller and, at the same time, the separation roller 63 is rotated in a direction opposite to the forward direction of the feed roller 62 from a separation roller driving unit 103 (STP 9).

The feed roller 62 and separation roller 63 of the separation/feed rollers 53 continue to rotate reversely until the leading edges of the stacked documents D pass between the rollers and return to the document tray 51 (STP 10). When the stacked documents D are returned to the tray from the separation/feed rollers 53, the pickup roller 52 lower again to resend them to the separation/feed rollers 53 (STP 11). The documents D are sensed by the sensors 64 and 65 of the stacked-document detector 54 (STP 12). If the documents D are fed one by one (STP 12, No), they are supplied to the aligning rollers 55 (STP 13). If the detector 54 detects again that the documents are stacked one on another, they are returned to the tray 51 (STP 12, Yes). This operation is repeated until the documents D are exactly separated one from another (STP 8 to 12).

If, however, the number of times of re-separation (the above repeated operations) is counted by a check counter 104 (STP 21), and the number of counts exceeds 5, the main controller 100 determines that the stacked documents D cannot be separated (STP 22). Thus, the feed operation of the ADF 1 is stopped, and the standby modes of the scanner 2, printer 3, and optical disk memory device 4 are released. In this time, an error message is displayed on a control panel (not shown) to instruct a user to check the state of the documents and resets them (STP 23). If the user reset the documents and depresses a start button of the image forming/storing apparatus, the uppermost one of the documents D on the tray 51 is picked up again.

As has been described, the thickness T of each document fed between the feed and separation rollers 62 and 63 is measured by sensors 64 and 65 to exactly detect whether stacked documents are fed or not. Since the sensors do not contact each other, the thickness of a document can be measured quickly and correctly. Furthermore, since the sensors are arranged face to face, the thickness of (stacked) documents can be measured more correctly than using a single sensor or plural sensors arranged in one direction.

Upon measuring a thickness which is greater than the maximum tolerance of the thicknesses of documents D which can be fed by the ADF 1, it is easily detected that the documents D are stacked one on another, and the stacked documents are returned to the feed/separation section. Therefore, even if there are stacked documents they are reliably separated one from another by the ADF 1 thereby improving copying efficiency of documents using an image forming apparatus and filing efficiency of the documents.

When stacked documents are fed again, the re-separation/feed operation is repeated while limiting the number of times to n. It is thus possible to prevent a decrease in efficiency due to an interruption of operation caused whenever an error occurs.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for feeding a document to an image reading section of an image forming apparatus, comprising:

a document table for stacking a plurality of documents;

feeding means for separating one by one the documents stacked on said document table and for feeding the documents one by one to the image reading section from said document table;

means for detecting if the feeding means has simultaneously fed more than one document;

first control means for controlling said feeding means to reversely feed the documents to said document table over a predetermined distance when said detecting means detects that two or more documents have been simultaneously fed by said feeding means;

second control means for controlling said feeding means to separate the documents, fed to said document table by said first control means and feed the documents one by one to the image reading section again;

means for counting the number of operations of said second control means; and third control means for stopping said first control means and said second control means when said counting means counts to a predetermined number.

2. An apparatus according to claim 1, wherein said feeding means includes a first roller for feeding the documents stacked on said document table and a second roller for separating the documents fed by said first roller, and said first control means includes fourth control means for controlling a rotating direction of the second roller and fifth control means for controlling an operation of said first roller so that said feeding means feeds the documents to said document table.

3. An apparatus according to claim 2, wherein the fourth control means includes means for rotating said second roller in a first direction when the documents stacked on said document table are fed and for rotating said second roller in a second direction opposite the first direction for a predetermined period of time when said detecting means detects that two or more documents are simultaneously fed by said feeding means; and said fifth control means includes means for separating said first roller from the documents when said detecting means detects that two or more documents are simultaneously fed by said feeding means.

* * * * *